US011109697B2

(12) United States Patent
Brooks

(10) Patent No.: US 11,109,697 B2
(45) Date of Patent: Sep. 7, 2021

(54) SYSTEM AND METHOD FOR FACE CRADLE COVER

(71) Applicant: Elizabeth J. Brooks, Tumwater, WA (US)

(72) Inventor: Elizabeth J. Brooks, Tumwater, WA (US)

( * ) Notice: Subject to any disclaimer, the term of this patent is extended or adjusted under 35 U.S.C. 154(b) by 0 days.

(21) Appl. No.: 16/868,485

(22) Filed: May 6, 2020

(65) Prior Publication Data

US 2020/0352366 A1 Nov. 12, 2020

Related U.S. Application Data

(60) Provisional application No. 62/843,560, filed on May 6, 2019.

(51) Int. Cl.

| | |
|---|---|
| ***A47G 9/02*** | (2006.01) |
| ***A61G 13/12*** | (2006.01) |
| ***A61G 13/00*** | (2006.01) |
| ***A47C 20/02*** | (2006.01) |

(52) U.S. Cl.
CPC ..... *A47G 9/0253* (2013.01); *A47C 20/026* (2013.01); *A61G 13/009* (2013.01); *A61G 13/121* (2013.01)

(58) Field of Classification Search
CPC .. A47G 9/0253; A47G 9/0283; A47C 20/026; A47C 7/386; A47C 7/383; A61G 13/009
See application file for complete search history.

(56) References Cited

U.S. PATENT DOCUMENTS

| | | | | |
|---|---|---|---|---|
| 2,357,789 | A * | 9/1944 | Levy | A47G 9/0253 5/490 |
| 7,000,274 | B2 | 2/2006 | Brown et al. | |
| 8,863,327 | B1 * | 10/2014 | Winn | A47G 9/007 5/490 |
| 2008/0263767 | A1 * | 10/2008 | Mooney | A47G 9/0253 5/490 |
| 2009/0222986 | A1 * | 9/2009 | Hamilton | A61H 37/00 5/488 |
| 2010/0269258 | A1 | 10/2010 | Pax | |
| 2017/0112298 | A1 * | 4/2017 | Hudson | A47G 9/0253 |
| 2017/0233240 | A1 * | 8/2017 | Bouzis | A47G 9/0253 222/131 |
| 2018/0199738 | A1 * | 7/2018 | Klein | A47G 9/0253 |
| 2018/0310731 | A1 * | 11/2018 | Staton | A47G 9/1081 |
| 2018/0360242 | A1 * | 12/2018 | Doty | A42B 1/041 |

* cited by examiner

*Primary Examiner* — Nicholas F Polito
*Assistant Examiner* — Alison N Labarge
(74) *Attorney, Agent, or Firm* — Christopher Mayle; Bold IP, PLLC

(57) ABSTRACT

System and method for adjustable, seamless face cradle cover providing a barrier between a patient from any unprotected and potentially unsanitary areas of the face cradle while allowing the patient to breathe freely and prevent creases forming on the patient's face.

8 Claims, 10 Drawing Sheets

SYSTEM AND METHOD FOR FACE CRADLE COVER

CROSS REFERENCE TO RELATED APPLICATIONS

The application claims priority to U.S. Provisional Application No. 62/843,560 filed on May 6, 2019, which is incorporated by reference in its entirety.

FIELD OF DISCLOSURE

The present invention relates to a cover for a massage table face cradle. More particularly, the invention is directed to an adjustable, seamless fitted cover for a massage table face cradle that maximizes comfort, does not leave crease marks on a user's face, and allows the user to breathe more easily when in use.

BACKGROUND

Massage therapy plays a very important part when incorporated into a physical therapy treatment plan such as providing stress relief and calm state of mind. Massage therapy may help patients establish slower calmer breathing patterns and better body awareness in areas related to pain or injury. Massage therapy treatments also have a therapeutic affect and improve health by acting directly on the muscular, nervous, circulatory, and lymphatic systems. Typically massage tables are used by massage therapists to position the client in a proper state to receive a massage. Most are manufactured with client comfort and therapist ergonomics in mind. A typical massage table has a heavily padded surface and a face cradle that allows the patient to breathe easily while lying face down.

The face cradle, also known as the headrest, head support, or face rest, keeps patients comfortable during the massage session. Since the patient's eyes, nose, mouth, and face come in contact with the face cradle it is also important to have a replaceable, cleanable, or disposable cover that fits over the face cradle, leaving no possibility of cross-contamination. While there are existing covers that attach to the face cradle, these covers are not suitable for the patient because the cover bunches up near the patient's air passageways making it harder to breathe. Other covers also have seams that press and indent on the patients face leading to an uncomfortable experience while on the table and an unsightly experience off the table. A sampling of these covers are illustrated in FIG. 1.

When a patient's face is secure in the face cradle, they should not feel any strain on the pressure points. FIG. 2 illustrates of the "u-shaped" lines that may be on the face of the patient after the massage. Sometimes these lines may go across the patient's eyes or cheeks depending on where the seams ended up on their face. Sometimes patients are face down for 45+ minutes with the seams of the cover digging into the skin. For anyone over 40 years of age, those lines can last for many hours after the massage. There are a few covers that describe themselves as seamless but still leave lines because they either do not completely cover the cradle (exposing patients to possible cross-contamination, against guidelines) or the fabric bunches up. Therefore, there is a need in the art for an improved face cradle cover for a massage table that provides these advantages.

SUMMARY

In one aspect, embodiments in the present description are directed to a face cradle cover having a seamless cover body, made of a fabric, having a center portion and left and right lateral portions configured to fit face cradles of different sizes, further comprising a flap connected to the center portion along an edge of center portion, the flap having two corners connected to the center portion, further comprising a casing against an outer perimeter of the center section and left and right lateral extensions, elastic bands may be secured within the casing, wherein flap is rectangle in shape, the flap reinforced with doubling material overlapping the casing at the corners of the flap, further comprising a pocket having openings built into an inside of cover body configured for storing for the flap, further comprising a face cradle wherein the face cradle cover covers a top surface, a side surface, and portion of a bottom surface of the face cradle, the flap may be split vertically into two more sections orientated at an angle from one another, further comprising a second pocket having openings built into the inside of cover body configured for storing for the sections of the flap.

In another aspect, embodiments in the present description are directed to a method for assembling a face cradle cover having a seamless cover body, the method comprising, cutting out a pattern for a cover body and a lining for a flap, the cover body having a center portion and left and right lateral portions configured to fit face cradles of different sizes, sewing lining onto the flap inside out and onto the edges of the cover body, sewing edges of the cover body, turning the flap right side out, snipping corners of the flap, ironing the corners of the flap, sewing casing, the casing configured for receiving an elastic band, inserting the elastic band into the casing, pulling elastic bands over and around a face cradle, the face cradle connecting to a massage table, pulling the flap and tucking the flap in a pocket, the pocket positioned on an inside surface of the cover body such that a patient may breathe more easily when positioned onto face cradle cover, reinforcing the flap with doubling material overlapping the casing at the corners of the flap.

BRIEF DESCRIPTION OF DRAWINGS

The present invention will be described by way of exemplary embodiments, but not limitations, illustrated in the accompanying drawings in which like references denote similar elements, and in which:

FIG. 4 depicts a top perspective view of the first embodiment of the present invention with the flap tucked in.

FIG. 5 depicts a bottom perspective view of the first embodiment of the present invention with the flap tucked in.

FIG. 6 depicts a rear perspective view of the first embodiment of the present invention with the flap tucked in.

DETAILED DESCRIPTION

Figure 1:
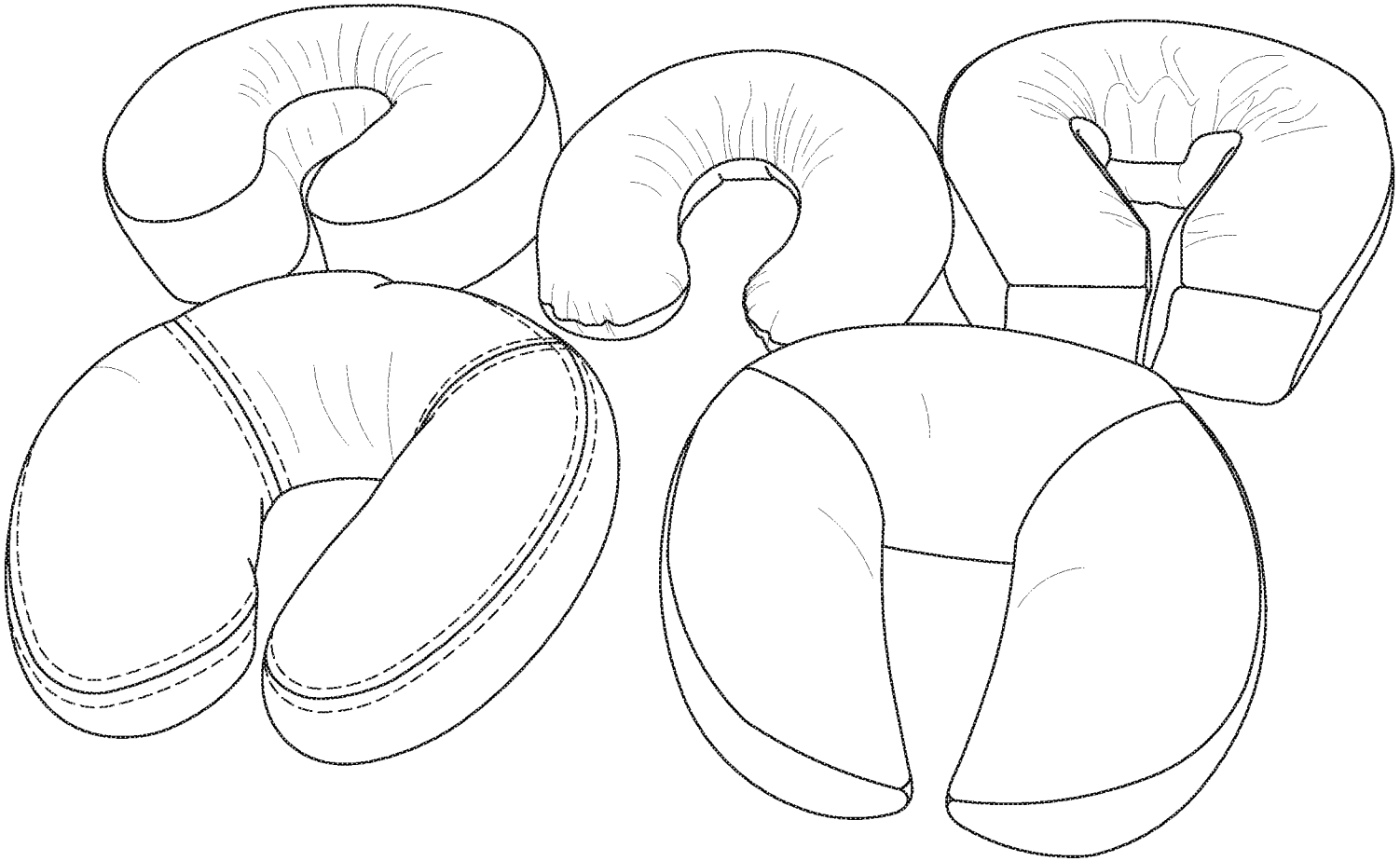
FIG. 1 depicts prior art embodiments of a face cradle cover.
Figure 2:
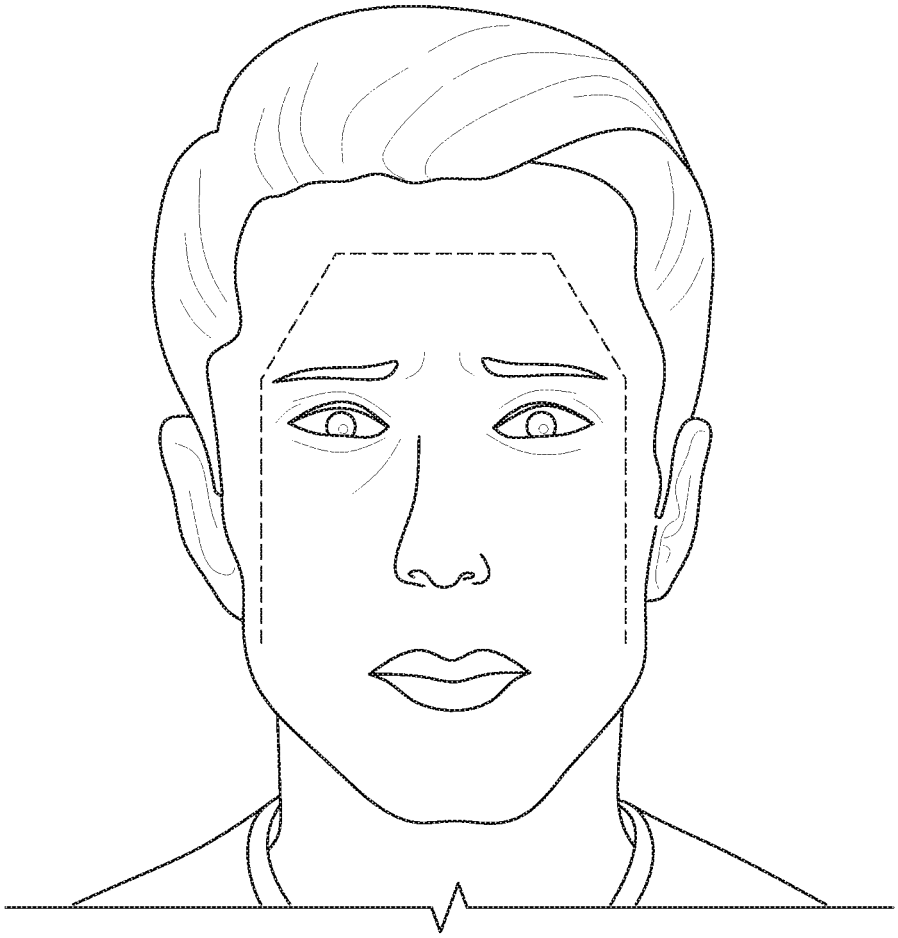
FIG. 2 depicts the lines on a human face after a massage with prior art.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined).

"Exemplary" is used herein to mean "serving as an example, instance, or illustration." Any aspect described in this document as "exemplary" is not necessarily to be construed as preferred or advantageous over other aspects Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items" may indicate the presence of only one item or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

Figure 3:
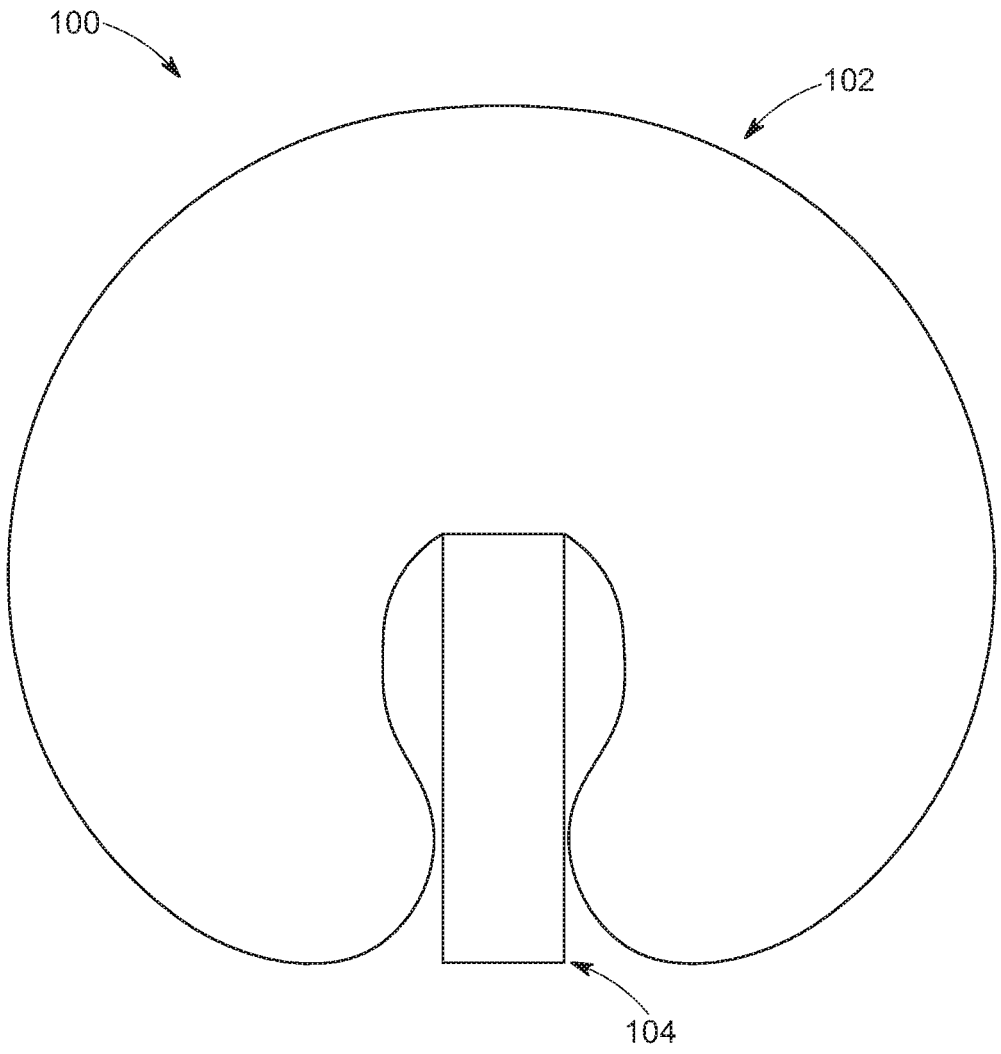
FIG. 3 depicts a top perspective view of a first embodiment of the present invention.

The present invention is directed to an adjustable, seamless face cradle cover providing a barrier between a patient from any unprotected and potentially unsanitary areas of the face cradle while allowing the patient to breathe freely and prevent creases forming on the patient's face, which is advantageous for patients so they can go anywhere, e.g. back to work, shopping, after a massage without the embarrassment of lines all over their face. With reference now to FIG. 3, one exemplary embodiment of face cradle cover system 100, according to the present invention is generally designated. Face cradle system 100 may have a cover body such as cover body 102 and a such as flap 104. Flap 104 and cover body 102 may be one single entity or may be removably or permanently attached to one another. Face cradle cover system 100 is configured to fully cover an adjustable face cradle regardless of the size, angle or longitudinal adjustment toward and away from a massage table. Face cradle cover system 100 may be disposable or washable, should the patient or massage therapist so desire, and in other embodiments may be swathed with an antibacterial product or coating.

Cover body 102 may be formed of a breathable, stretchable, moisture absorbable fabric. For instance the material may be but is not limited to a knit material, such as a cotton based fabric, linen, polyester, spandex, or polypropylene fabric. The cover body 102 may be cut out of a pattern on knit material where the edges are sewn. Cover body 102 may have a central section and left and right lateral extensions, each of which integrally connect to the central section. The central section having a rectangular shape with a top side and bottom side of smaller length than the sidewalls. Sidewalls terminate into left and right lateral extensions which are arcuately-shaped end portions in shapes.

Cover body 102 may include one or more bands of resilient material having a greater modulus of elasticity than that of the cover body 102, whereby the bands may be secured within the cover body 102 against or proximally against the outer perimeter of the center section and left and right lateral extensions in a casing. Cover body 102 may have sewn openings or hem whereby the resilient material may be inserted into the openings and then secured by the openings being fastened closed. The openings or hem provide a firm and stable securement of the cover to the bands. The bands may be in a tensile state such that it adds rotational forces against the cover body 102 when expanded. The resilient material for the bands may be selected according to their modulus of elasticity to tightly engage each of the lines of dependency such that the cover body 102 will remain firmly engaged against all surfaces including the face cradle when positioned over the face cradle. The bands are designed so to be able to stretch and then firmly engage face cradles of all shapes and sizes.

Figure 4:
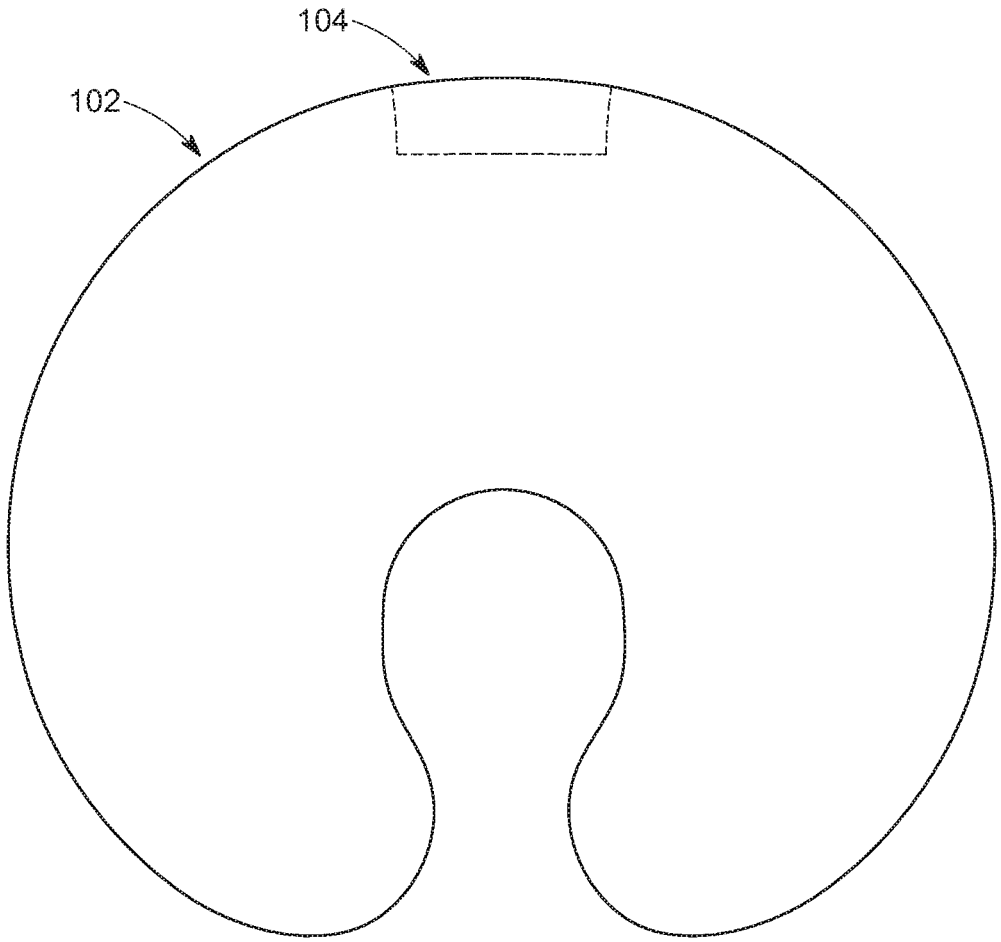
Figure 5:
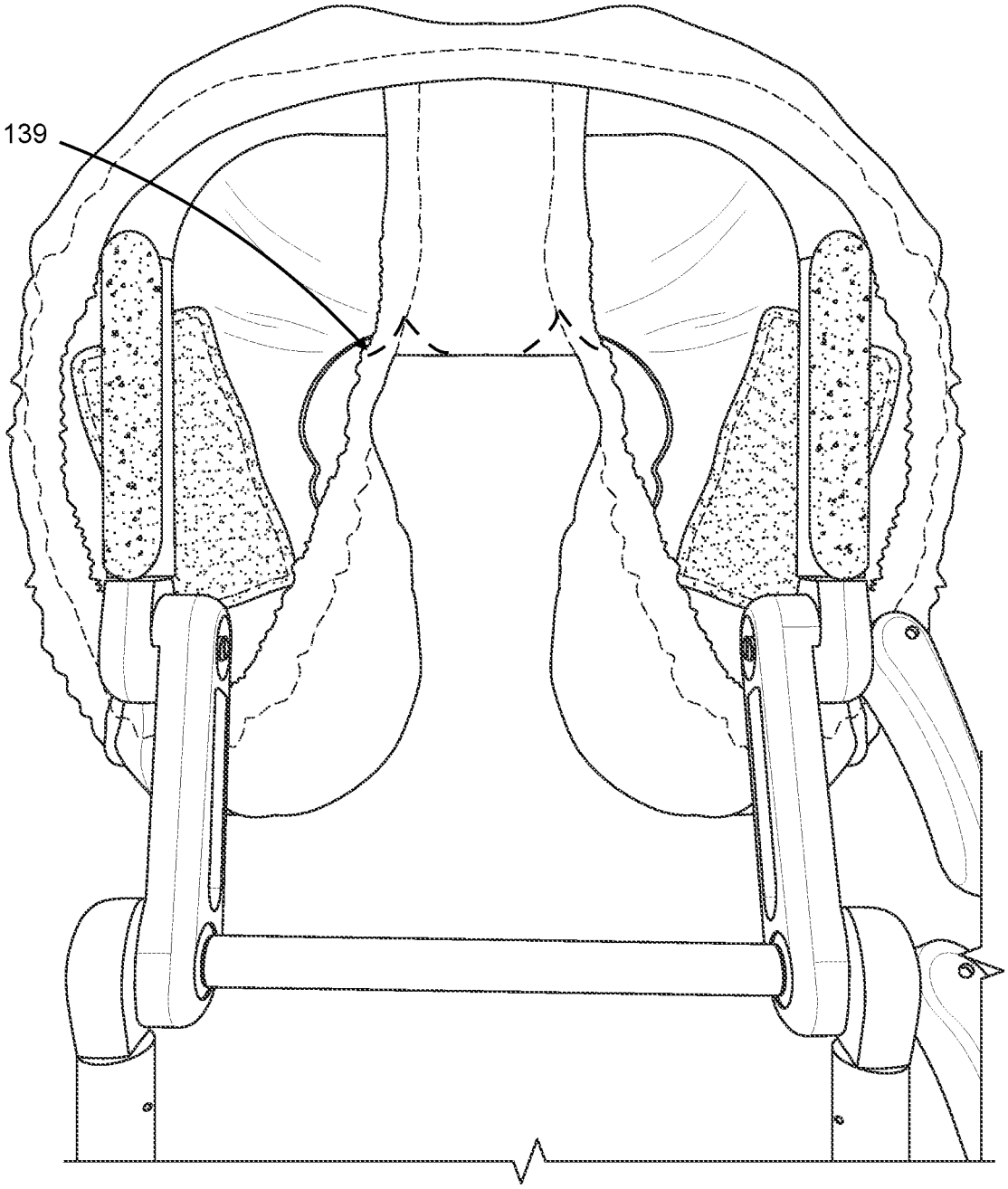
Figure 6:
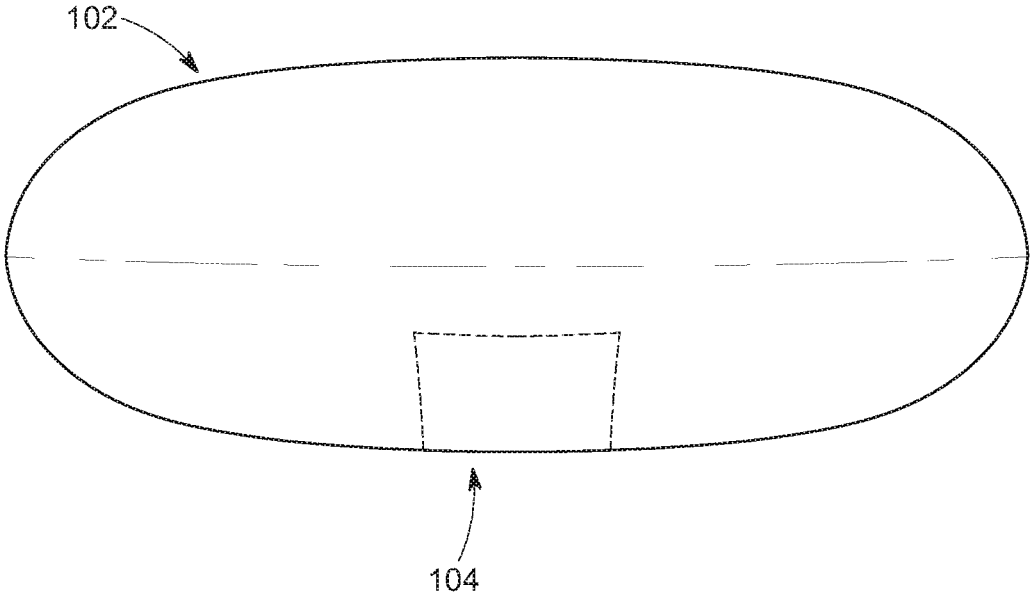

Flap 104 may be connected to the central portion of cover body 102 along an edge including two corners. Flap 104 may be cut out of a pattern on knit material in a similar method to the cover body 102 or may also be part of a one-piece pattern alongside the cover body 102 with a lining attached to it. In one or more embodiments, the corner section formed between cover body 102 and the flap 104 is then reinforced by doubling or more the material 139 on the flap 104 which overlaps the cover body 102 at the corners as illustrated in FIG. 5. When face cradle cover system 100 is in use and applied on a face cradle, flap 104 may be passed under cover body 102 and tucked in between cover body 102 and face cradle, as illustrated in FIG. 4-6 to provide more room for a patient to breathe and to deliver an orderly appearance of face cradle cover system 100. In other non-limiting embodiments, flap 104 may be positioned inside pocket such as pockets 115 having openings built into the inside of cover body 102 or may be fastened to cover body 102 by any number of fasteners, adhesive, latches, or hinges. For example, flap 104 may have a button fastened at the end of flap 104 whereby the button may be removably inserted into an opening on the back of cover body 102. In further embodiments flap 104 may have a magnet fastened at a length of flap 104 whereby the magnet may be removably connected to another magnet on pocket 115 or cover body 102.

In some embodiments, an area of flap 104, the inside of pocket 115, and/or a strip connected to flap 104 or pocket 115 may have one or more fibers (such as mohair, nylon, or a suitable material) that exhibit low friction when flap 104 comes in contact with the fibers moving in the same direction of the fibers, which can also be described as flap 104 being placed in pocket 115, and exhibit high friction when flap 104 comes in contact with the fibers moving in the opposite direction of the fibers which means the movement of flap 104 is impeded (i.e. restricted, halted, and/or prevented) thus providing a more secure connection.

Figure 7:
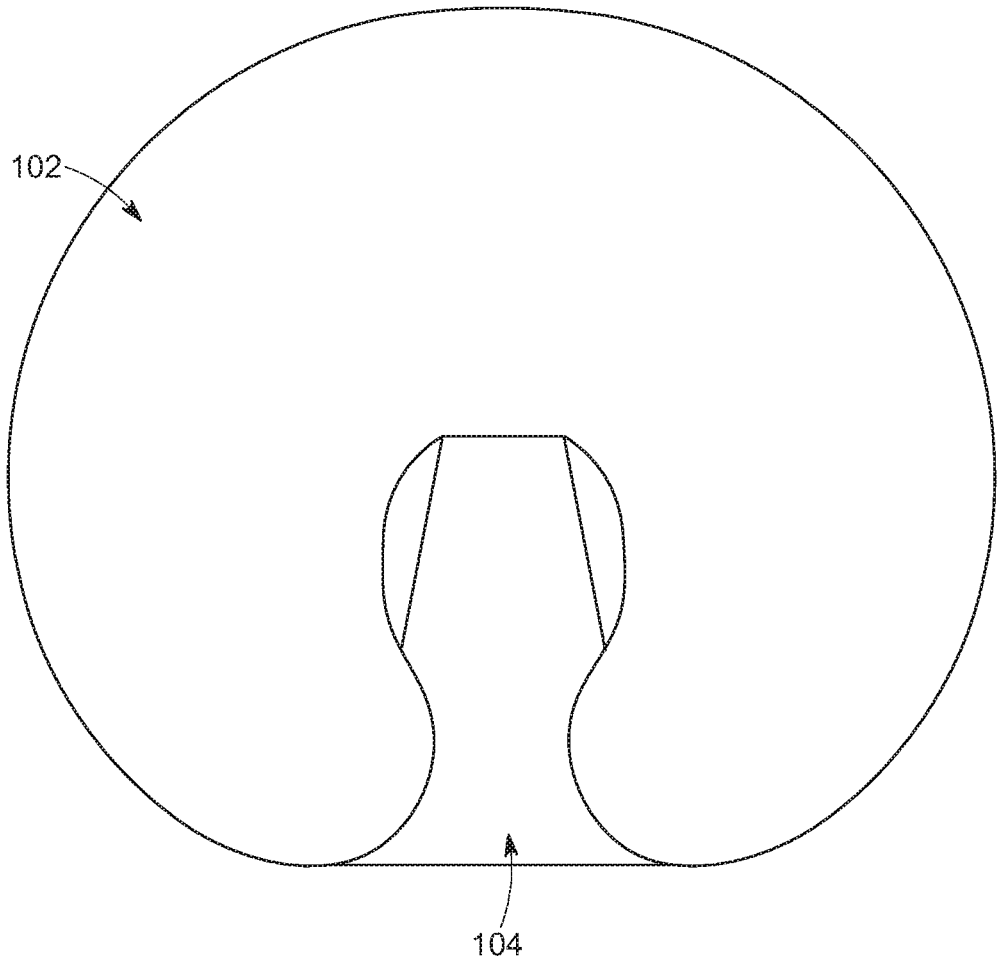
FIG. 7 depicts a top perspective view of a second embodiment of the present invention.
Figure 8:
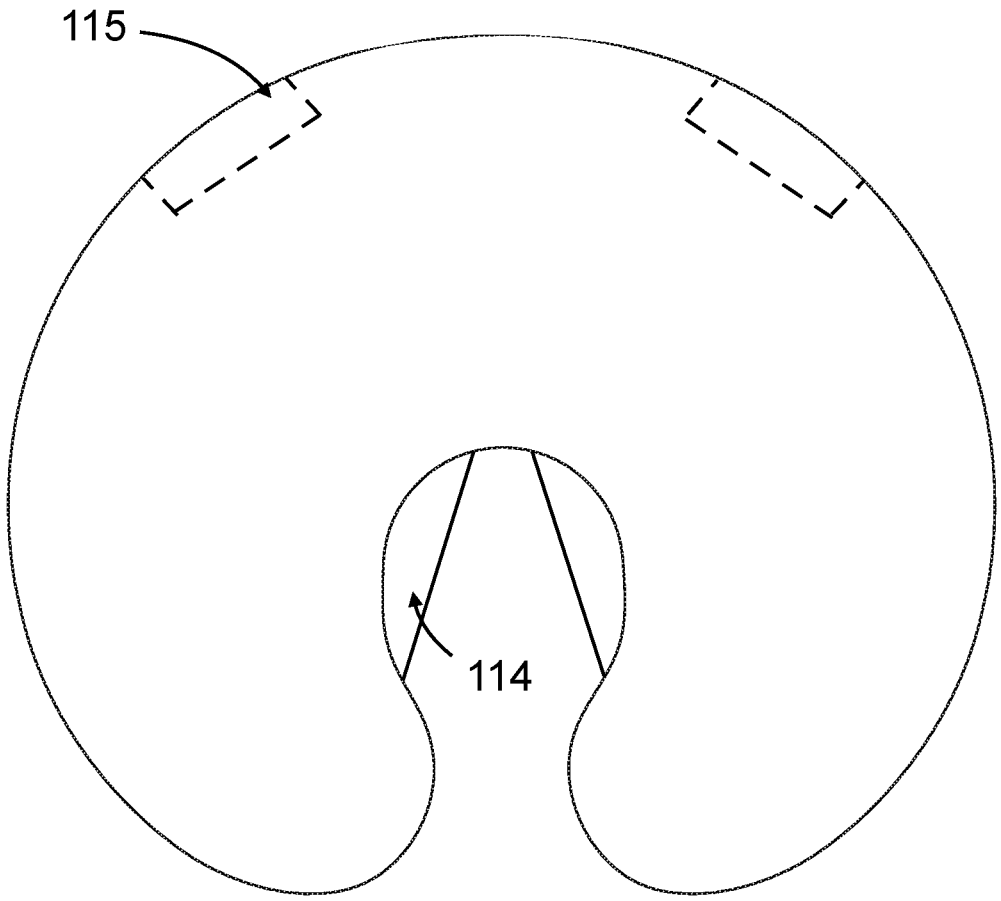
FIG. 8 depicts a perspective view of a third embodiment of the present invention.

Flap 104 is shown to be rectangular in shape, however, this is non-limiting and flap 104 may be square, circular, oval, triangle, trapezoid, octagon, or hexagon in shape such as the shape shown in FIG. 7. In one or more non-limiting embodiments, flap 104 may be split vertically into two more sections 114 orientated at an angle to be stored in pockets 115 for special needs of the patient as shown in FIG. 8.

Figure 9:
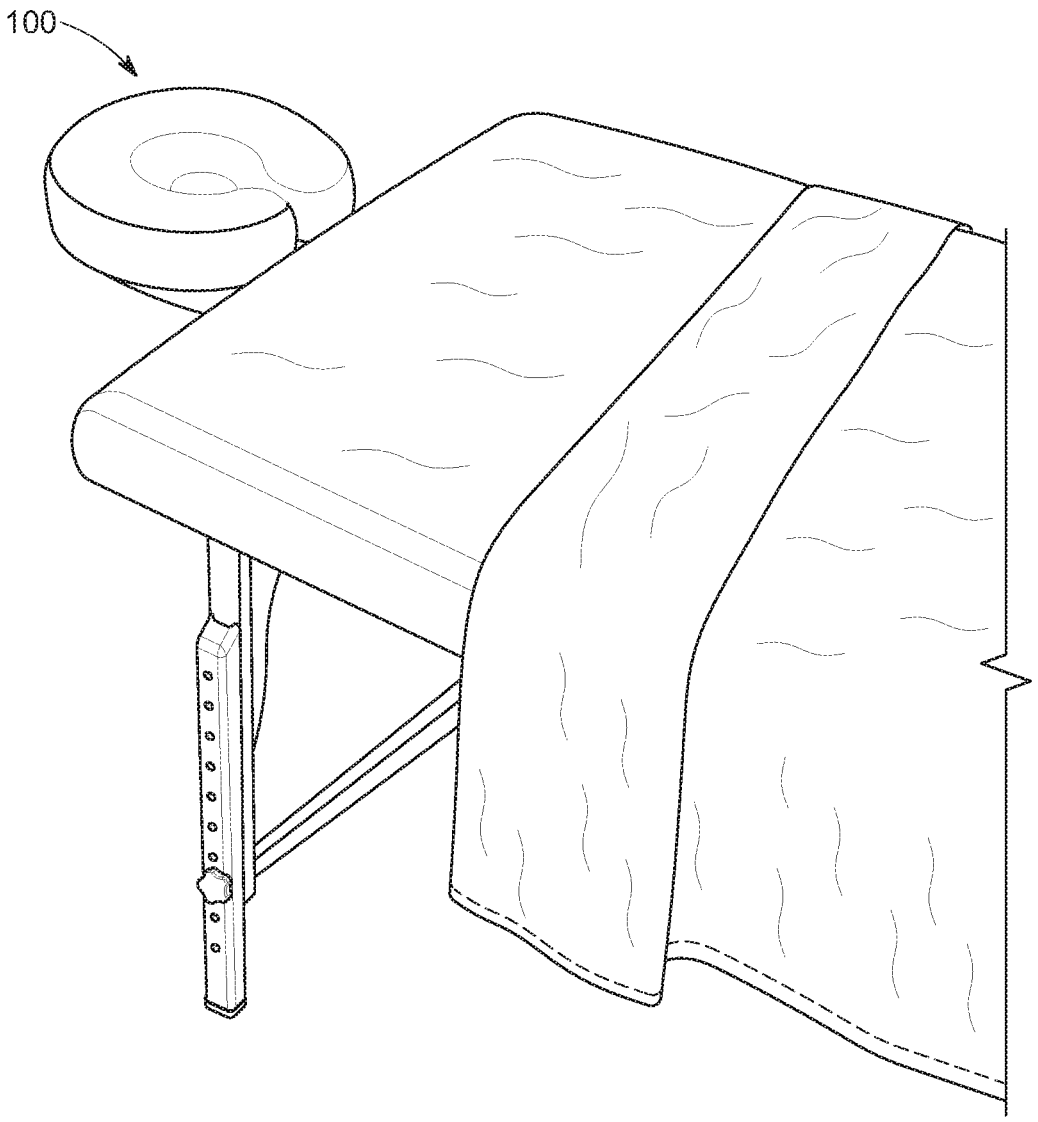
FIG. 9 depicts a perspective view of the first embodiment in an environment.
Figure 10:
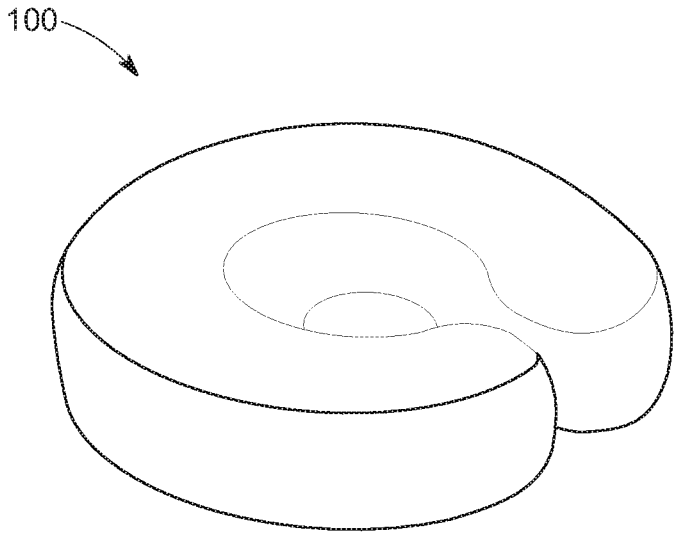
FIG. 10 depicts a close up perspective view of the first embodiment from FIG. 9.

One method of use is illustrated in FIG. 9-10 wherein the pattern for cover body 102 of face cradle cover system 100 and a lining for flap 104 or flaps is cut out from a knit material. The lining is then sewn onto flap 140 inside out and onto the edges of cover body 102. The edges of cover body 102 are then sewn. The corners are snipped and ironed, then turned right side out. The casing for one or more elastic bands is then sewn leaving openings for the elastic bands. The elastic bands are then inserted into the casings. The elastic bands are then fastened and the openings to the casings are closed. The bands of resilient material are pulled over and around a face cradle, the face cradle connected to a massage table. whereby the bands are secured over the outer perimeter of the face cradle. Cover body 102 is then positioned in place over face cradle 200 connected to a massage table 300. In this configuration cover body 102 fully covers the inner area face cradle 200 preventing cover body 102 from pulling forward leading to lines on patient's faces and the added risk of cross contamination. When a patient lies down with their face positioned over cover body 102, the flap may then be pulled back and tucked into cover body 102 such that the patient may breathe more easily.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the below claims.

What is claimed is:

1. A face cradle cover having:

an adjustable cover body, made of a fabric, having a center portion and left and right lateral portions configured to fit one or more face cradles of different sizes, wherein the cover body has a u shape with an outer bend and inner bend, wherein the cover body is seamless and the fabric of the cover body does not bunch up wherein the cover body is configured to not invade breathing area of a user and leaves no indentation lines being left on a face of the user; and a flap portion connected to the center portion along an apex of the inner bend, the flap portion having two corners connected to the apex, the flap portion having an unattached end that moves from a first position to a second position by passing under a back of the cover body and tucked in between an inside of the cover body and the cradle, the flap portion connected to the center portion such that when pulled back provides more breathing room for the user.

2. The face cradle cover of claim 1 further comprising:

a casing against an outer perimeter of a center section and left and right lateral extensions; and elastic bands may be secured within the casing.

3. The face cradle cover of claim 2 wherein the flap portion has a fastener that is configured to be received by the cover body to hold the flap portion in place.

4. The face cradle cover of claim 3 further comprising: a face cradle wherein the face cradle cover covers a top surface, a side surface, and portion of a bottom surface of the face cradle.

5. The face cradle cover of claim 3, the flap portion splittable-into two more sections orientated at an angle from one another.

6. The face cradle cover of claim 2, the face cradle cover made of a fabric, wherein the face cradle cover is created by cutting out a pattern for the cover body and a lining for the flap portion, the lining sewn onto the flap portion inside out and onto edges of the cover body, corners of the flap portion snipped then ironed and the flap portion turned right side out then a casing is sewn along the edges.

7. A face cradle cover having:

an adjustable cover body, made of a fabric, having a center portion and left and right lateral portions configured to fit one or more face cradles of different sizes, wherein the cover body has a u shape with an outer bend and inner bend, wherein the cover body has a contact area configured for a user to come in contact with when the face cradle cover is positioned over a face cradle, wherein the contact area is seamless and non-bunching such that the contact area is configured to not invade a breathing area of a user and leave no indentation lines being left on a face of the user, and the cover body having a T shape extending to a bottom made of one piece of fabric wherein in a middle of an inner bend the cover body extends into a flap portion, the flap portion having an unattached end that moves from a first position to a second position by passing under a back of the cover body and tucked in between an inside of the cover body, the flap portion connected to the center portion such that when pulled back provides more breathing room for the user.

8. The face cradle cover of claim 7, the adjustable cover body is made of a single piece of fabric.

* * * * *